US006296199B1

(12) United States Patent
Noller et al.

(10) Patent No.: US 6,296,199 B1
(45) Date of Patent: Oct. 2, 2001

(54) FUEL INJECTION VALVE

(75) Inventors: Klaus Noller, Oppenweiler; Martin Mueller, Moeglingen; Reinhold Bruekner, Litzendorf; Juergen Rapp, Esslingen, all of (DE); Rainer Kocik, Charleston, SC (US); Juergen Schubert, Bamberg (DE); Konrad Funk, Gundelsheim (DE); Clemens Willke, Oberstenfeld (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/530,329

(22) PCT Filed: Aug. 25, 1999

(86) PCT No.: PCT/DE99/02657

§ 371 Date: Jul. 7, 2000

§ 102(e) Date: Jul. 7, 2000

(87) PCT Pub. No.: WO00/12891

PCT Pub. Date: Mar. 9, 2000

(30) Foreign Application Priority Data

Aug. 27, 1998 (DE) ..... 198 38 949
Jun. 15, 1999 (DE) ..... 199 27 196

(51) Int. Cl.[7] ..... F02M 61/00

(52) U.S. Cl. ..... 239/533.12

(58) Field of Search ..... 239/533.12, 533.2, 239/463, 494, 585.1

(56) References Cited

U.S. PATENT DOCUMENTS 5,086,979 * 2/1992 Koblish et al. ..... 239/533.12
5,437,413 * 8/1995 Shen et al. ..... 239/533.12
5,570,841 * 11/1996 Pace et al. ..... 239/585.1
5,875,972 * 3/1999 Ren et al. ..... 239/463
6,039,272 * 3/2000 Ren et al. ..... 239/497
6,065,692 * 5/2000 Brinn, Jr. ..... 239/533.12

FOREIGN PATENT DOCUMENTS 39 43 005 7/1990 (DE) .
197 36 682 2/1999 (DE) .
0 350 885 1/1990 (EP) .
99 32784 7/1999 (WO) .

* cited by examiner

*Primary Examiner*—Thomas N. Moulis
(74) *Attorney, Agent, or Firm*—Kenyon & Kenyon

(57) ABSTRACT

A fuel-injection valve, in particular, a high-pressure injection valve, for injecting fuel directly into a combustion chamber of a mixture-compressing internal combustion engine with externally supplied ignition is distinguished by the fact that a guide and seating area formed by three disc-shaped elements is provided at a downstream end of the valve. A swirl element is embedded between a guide element and a valve seat element. The guide element is used to guide a valve needle which passes through it and can move in the axial direction, while a valve closing segment of the valve interacts with a valve seat surface of the valve seat element. The swirl element has an inner opening area with multiple swirl channels. The three disc-shaped elements are permanently connected to each other, forming a positive-locking joint.

21 Claims, 11 Drawing Sheets

FUEL INJECTION VALVE

BACKGROUND INFORMATION

1. Field of the Invention

The present invention relates to a fuel injection valve.

2. Background Information

An electromagnetically operated fuel-injection valve that has multiple disc-shaped elements arranged in its seating area is described in German Patent No. 39 43 005. Upon excitation of a magnetic circuit, a flat valve plate acting as a flat armature lifts up from a valve seat plate situated opposite from and interacting with the flat valve plate. The flat valve plate and the valve seat plate together form a plate valve part. A swirl element, which sets the fuel flowing to a valve seat in a circular rotary motion, is located upstream from the valve seat plate. A stop plate limits the axial displacement of the valve plate on the side opposite the valve seat plate. The swirl element surrounds the valve plate, leaving a large amount of clearance; the swirl element thus guides the valve plate to a certain degree. At the lower end of the swirl element there are provided multiple tangential grooves, which begin at the outer circumference and extend all the way to a central swirl chamber. When the lower end of the swirl element lies against the valve seat plate, the grooves become swirl channels.

In addition, a fuel-injection valve is described in from Unexamined European Published Patent application No. 0 350 885, in which a valve seat body is provided, with a valve closing member located on an axially movable valve needle interacting with a valve seat surface of the valve seat body. A swirl element, which sets the fuel flowing to a valve seat in a circular rotary motion is located upstream from the valve seat surface in a recess in the valve seat body. A stop plate limits the axial displacement of the valve needle, with the stop plate having a central opening that is used to guide the valve needle to a certain extent. The opening in the stop plate surrounds the valve needle with a large amount of clearance because the fuel to be supplied to the valve seat must also pass through this opening. At the lower end of the swirl element there are multiple tangential grooves, which begin at the outer circumference and extend all the way to a central swirl chamber. When the lower end of the swirl element lies against the valve seat body, the grooves become swirl channels.

SUMMARY OF THE INVENTION

The fuel-injection valve according to the present invention has the advantage that it can be produced easily and economically. The injection valve can be mounted easily, and yet very precisely, especially at its downstream end. Particular advantages are obtained for finishing surfaces on a guide element and valve seat element. Because the guide element, swirl element, and valve seat element are permanently connected even prior to being mounted on the injection valve, the guide opening in the guide element, the valve seat surface in the valve seat element and a contact surface of either the guide element or the valve seat element-which, in the end, comes to rest against the valve housing, i.e. valve seat carrier-can be finished, e.g. ground, in a clamp.

In addition, the disc-shaped swirl element has a very simple structure, making it easy to form. The function of the swirl element is to produce a swirling or rotary motion in the fuel, thus preventing the formation of turbulence in the fluid, which may produce disturbances. All other valve functions are performed by other valve components. The swirl element can thus be worked to the best advantage. Because the swirl element is a single component, there are no limits to how it can be handled during the production process. Compared to swirl elements that have grooves or similar swirl-producing depressions on one end face, an inner opening area, which extends across the entire axial thickness of the swirl element and is surrounded by an outer circumferential edge area, can be produced with very simple means in the swirl element.

Like the swirl element and the valve seat element, the guide element is also easy to produce. In an advantageous manner, the guide element has an inner guide opening and is used to guide the valve needle that projects through the inner guide opening. Designing the guide element with projecting tooth-shaped areas that alternate with intermediate recesses on its outer circumference makes it possible to easily ensure optimum flow into the swirl channels in the underlying swirl element.

The modular structure of the elements and the separation of functions associated with this have the advantage that the individual components can be designed with a great deal of flexibility, making it possible to produce different spray patterns (spray angle, static spray volume) simply by varying one element. Additional spray or fastening elements can also be easily provided. Despite the variable design of the individual elements, the permanent connection between all elements makes this valve body very easy to handle.

DETAILED DESCRIPTION

Figure 1:
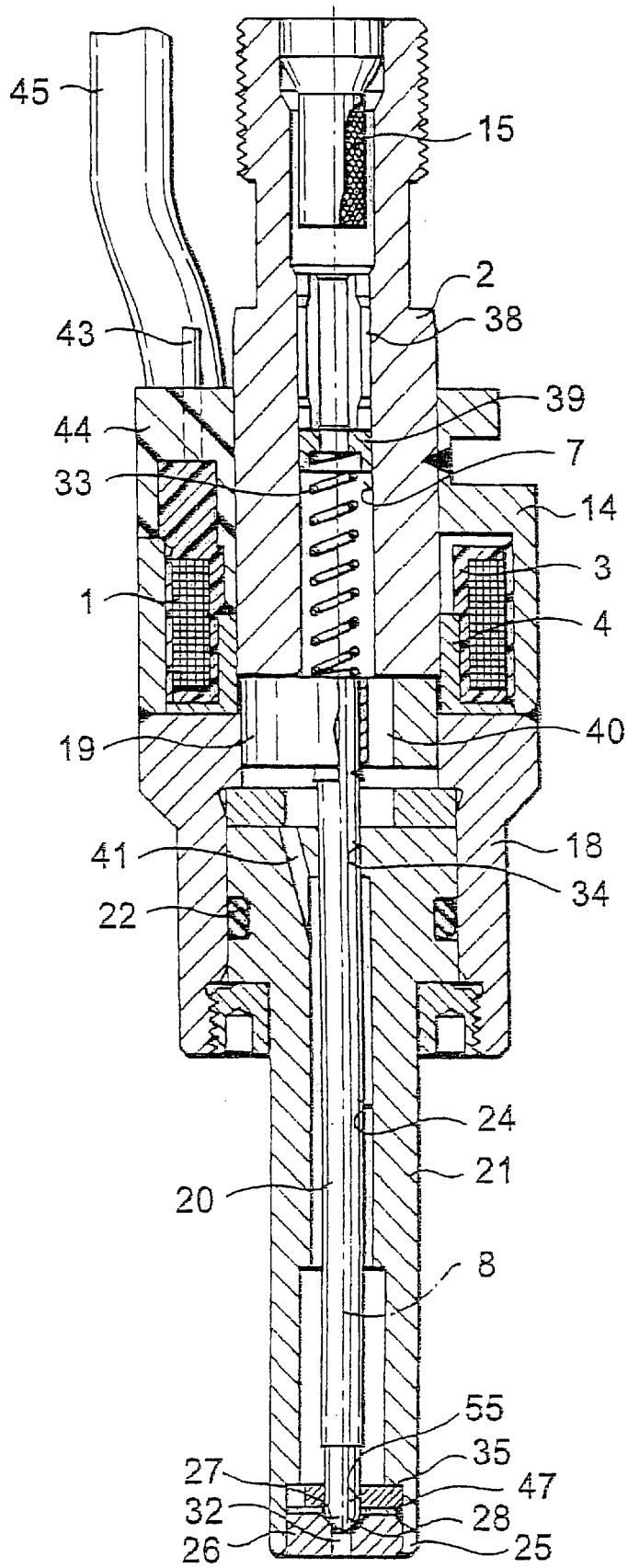
FIG. 1 shows a first embodiment of a fuel injection valve according to the present invention.

The electromagnetically operated valve illustrated, for example, as one embodiment in FIG. 1 in the form of an injection valve for fuel injection systems in internal combustion engines with externally supplied ignition has a tubular, largely hollow cylindrical core 2 serving as the inner pole of a magnetic circuit and at least partially surrounded by a solenoid 1. The fuel injection valve is suitable, in particular, for use as a high-pressure injection valve for injecting fuel directly into a combustion chamber of an internal combustion engine. A plastic bobbin 3 that has a stepped design, for example, holds one winding of solenoid 1 and, in connection with core 2 and a non-magnetic annular intermediate section 4, which is partially surrounded by solenoid 1 and has an L-shaped cross-section, allows the injection valve to have an especially compact and short design in the region of solenoid 1.

A longitudinal through-opening 7 extending along a longitudinal valve axis 8 is provided in core 2. Core 2 of the magnetic circuit also acts as a fuel intake tube connector, with longitudinal opening 7 representing a fuel intake channel. Permanently attached to core 2 above solenoid 1 is an outer metallic (e.g. ferritic) housing section 14, which closes the magnetic circuit in the form of an outer pole, i.e. outer conductive element, and completely surrounds solenoid 1, at least in the circumferential direction. A fuel filter 15, which filters out fuel components that are large enough to block or damage the injection valve, is provided at the intake end in longitudinal opening 7 of core 2. Fuel filter 15 is fixed in place, for example, by pressing it into core 2. Together with housing section 14, core 2 forms the intake end of the fuel injection valve, with upper housing section 14 extending just beyond solenoid 1, e.g. in an axial direction, from a downstream perspective. A lower tubular housing section 18, which surrounds, i.e. holds, for example, an axially moving valve part that includes an armature 19 and a rod-shaped valve needle 20 and/or a longitudinal valve seat carrier 21, is permanently attached to upper housing section 14, forming a seal. Both housing sections 14 and 18 are permanently joined together, for example, by a circumferential welded seam.

In the embodiment shown in FIG. 1, lower housing section 18 and largely tubular valve seat carrier 21 are screwed together permanently; they can also be joined by welding, soldering or flanging. The joint between housing section 18 and valve seat carrier 21 is sealed, for example, by a gasket 22. Along its entire axial width, valve seat carrier 21 has an inner passage 24, which is positioned concentrically to longitudinal valve axis 8.

With its lower end 25, which also forms the downstream end of the entire fuel injection valve, valve seat carrier 21 surrounds a disc-shaped valve seat element 26 that is fitted into passage 24 and has valve seat surface 27 which is tapered in the shape of a truncated cone in the downstream direction. Valve needle 20, which has for example a rod-shaped, largely circular cross-section and a valve closing segment 28 at its downstream end, is positioned in passage 24. This, for example, conical or partially conical, i.e., partially spherical or conically tapered valve closing segment 28 interacts in the a conventional manner with valve seat surface 27 provided in valve seat element 26. In addition to the illustrated embodiment with armature 19, valve needle 20, and valve closing segment 28, the valve component moving in the axial direction can also be designed completely differently in the form of a valve closing member that moves in the axial direction, for example a flat armature. Downstream from valve seat surface 27, at least one discharge opening 32 for the fuel is provided in valve seat element 26.

The injection valve is operated electromagnetically in a conventional manner. However, it is also possible to use a piezoelectric actuator as the excitable control element. Operation via a controlled pressure-loaded piston is also possible. An electromagnetic circuit containing solenoid 1, core 2, housing sections 14 and 18, and armature 19 is used to move valve needle 20 in the axial direction, thus opening the injection valve against the force of a resetting spring 33 located in longitudinal opening 7 of core 2, or closing it. Armature 19 is connected to the end of valve needle 20 facing away from valve closing segment 28, for example by a welded seam, and oriented toward core 2. A guide opening 34 provided in valve seat carrier 21 at the end facing armature 19 and a disc-shaped guide element 35 with a dimensionally accurate guide opening 55 located upstream from valve seat element 26 are used to guide valve needle 20 while it is moving in an axial direction along longitudinal valve axis 8, together with armature 19. During its axial movement, armature 19 is surrounded by intermediate section 4.

A further disc-shaped element, i.e. a swirl element 47, is provided between guide element 35 and valve seat element 26, so that all three elements 25, 47, and 26, are arranged directly next to each other vertically and held in valve seat carrier 21. According to the present invention, all three disc-shaped elements 35, 47, and 26 are permanently connected to each other, forming a positive-locking joint.

An adjusting sleeve 38, which is pushed, pressed, or screwed into longitudinal opening 7 of core 2, is used to adjust the pre-tension of resetting spring 33, whose upstream end rests against adjusting sleeve 38 and whose opposite end is supported on armature 19, using a centering piece 39. Provided in armature 19 are one or more bore-like flow channels 40 through which the fuel can reach passage 24 from longitudinal opening 7 in core 2 via connecting channels 41 provided downstream from flow channels 40 and close to guide opening 34 in valve seat carrier 21.

The stroke of valve needle 20 is defined by the position in which valve seat element 26 is mounted. When solenoid 1 is not excited, one end position of valve needle 20 is established when valve closing segment 28 comes to rest against valve seat surface 27 of valve seat element 26, while the other end position of valve needle 20 is established when armature 19 comes to rest against the downstream end of core 2 when solenoid 1 is excited. The surfaces of the components in the latter stop area are, for example, chromium-plated.

Solenoid 1 is electrically contacted, and thus excited, by contact elements 43, which are provided with a plastic extrusion layer 44 outside bobbin 3. Plastic extrusion layer 44 can also cover additional components of the fuel injection valve (such as housing sections 14 and 18). An electric connecting cable 45, used to supply power to solenoid 1, extends out from plastic extrusion layer 44. Plastic extrusion layer 44 projects through upper housing section 14, which is interrupted in this region.

Figure 2:
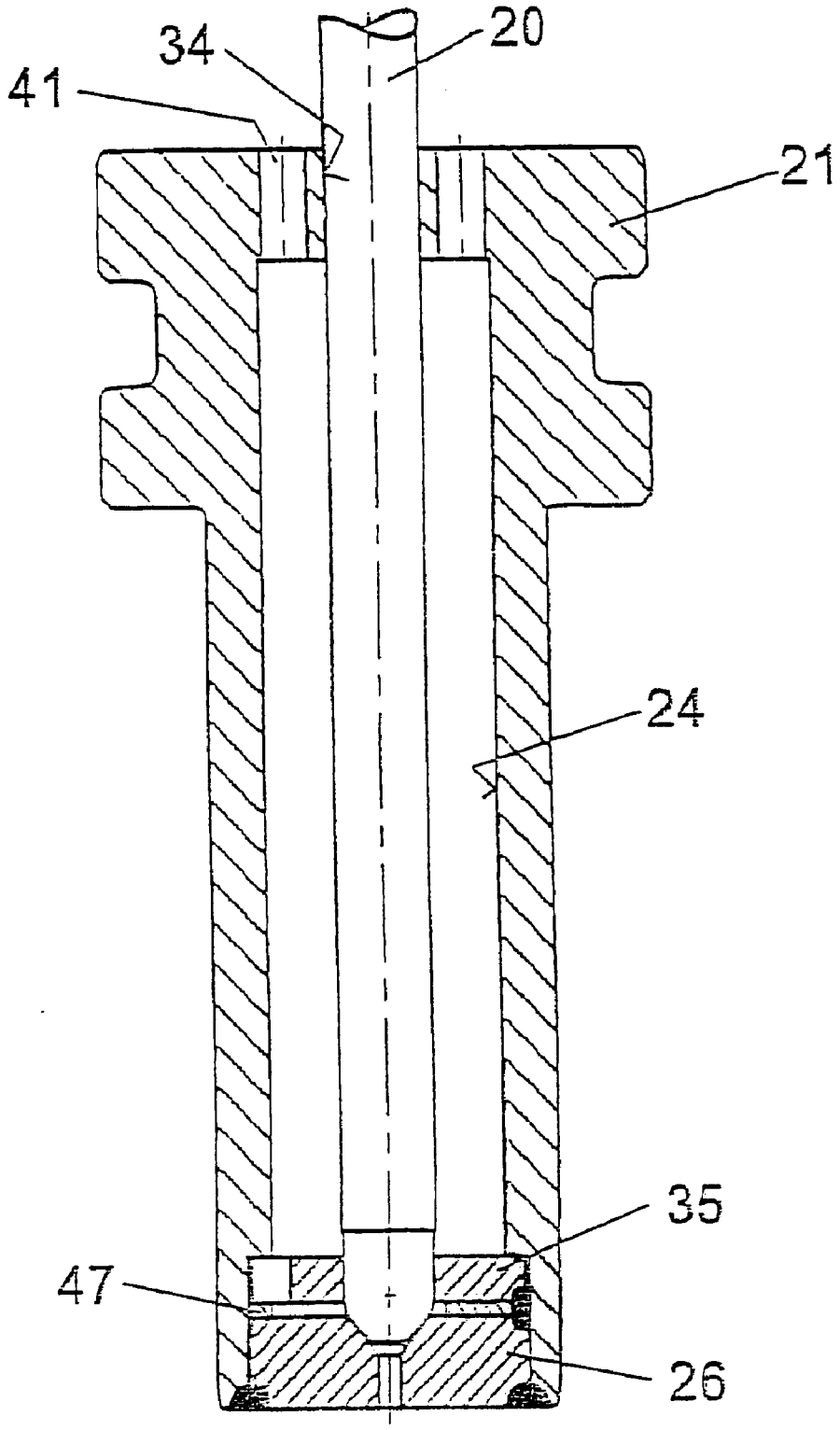
FIG. 2 shows a second embodiment of a downstream end of a fuel injection valve according to the present invention.
Figure 3:
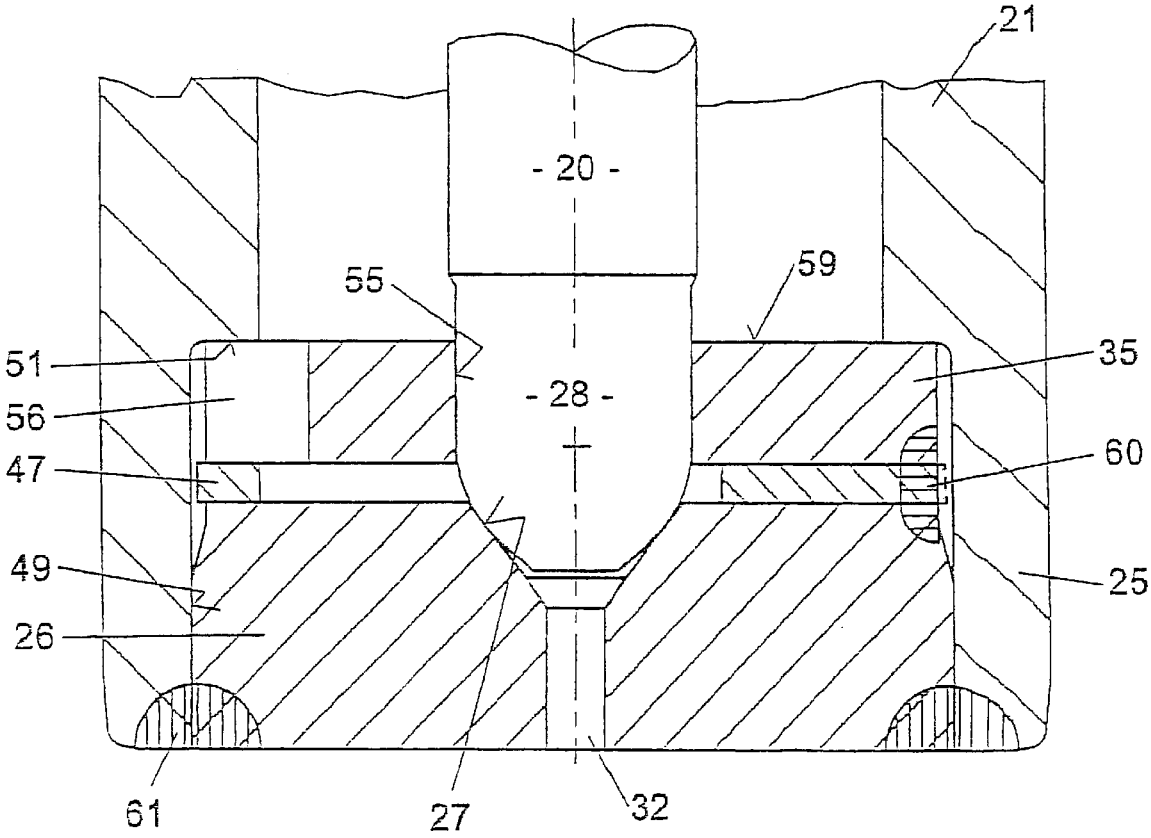
FIG. 3 shows an enlarged section of a first embodiment of a guide and seating area as shown in FIG. 2.

FIG. 2 shows a second embodiment of a fuel injection valve, with only the downstream end of the valve being illustrated. Unlike the embodiment shown in FIG. 1, multiple paraxial connecting channels 41 are provided in the region of guide opening 34 in valve seat carrier 21. To ensure reliable flow into valve seat carrier 21, passage 24 is designed with a larger diameter, while valve seat carrier 21 has a thin-walled design. FIG. 3 shows the guide and seating area extracted from FIG. 2 on a different scale to more clearly illustrate this valve area designed according to the present invention. The guide and seating area provided in passage 24 at injection end 25 of valve seat carrier 21 is illustrated in FIG. 3 and generally formed by three disc-shaped, permanently connected, yet functionally separate, elements arranged consecutively in an axial direction in all other subsequent embodiments according to the present invention. Guide element 35, very flat swirl element 47, and valve seat element 26 are arranged consecutively in the downstream direction.

Valve seat element 26, in part, has an outer diameter that allows it to fit tightly and with little clearance into a lower segment 49 of passage 24 in valve seat carrier 21 downstream from a stage 51 provided in passage 24. Guide element 35 and swirl element 47, for example, have a slightly smaller outer diameter than does valve seat element 26.

Guide element 35 has a dimensionally accurate inner guide opening 55 through which valve needle 20 moves during its axial motion. Starting at its outer circumference, guide element 35 has multiple recesses 56 distributed over its circumference, thus ensuring that fuel flowing along the outer circumference of guide element 35 enters swirl element 47 and continues in the direction of valve seat surface 27. Embodiments of swirl element 47 and guide element 35, respectively, are described in greater detail on the basis of FIGS. 10 to 15.

Three elements 35, 47, and 26 lie directly side-by-side with their ends touching and are already permanently joined together prior to being installed in valve seat carrier 21. Individual disc-shaped elements 35, 47, and 26 are permanently connected to form a positive-locking joint on the outer circumference of elements 35, 47, 26, with welding or bonding being the preferred joining methods. In the embodiment shown in FIG. 3, spot welds, i.e. short welded seams 60, are provided in the circumferential areas in which guide element 35 has no recesses 56. After three elements 35, 47, and 26 have been connected, guide opening 55, valve seat surface 27, and upper end 59 of guide element 35 are ground in a clamp. As a result, these three surfaces have a very slight radial eccentricity in relation to one another.

The complete multi-disc valve body is inserted, for example, into passage 24 until upper end 59 of guide element 35 comes to rest against stage 51. The valve body is attached, for example, by a welded seam 61, produced by a laser, between valve seat element 26 and valve seat carrier 21 at the lower end of the valve.

In the further embodiments shown in the subsequent figures, the parts that remain the same or perform the same functions as in the embodiment illustrated in FIGS. 2 and 3 are identified by the same reference numbers. The embodiments of guide and seating areas shown in FIGS. 4 to 9 and FIGS. 16 to 19, respectively, all have the main features of the three-disc embodiment and are also permanently connected to one another. The main differences lie in the design of discharge opening 32 in valve seat element 26 and the method for attaching valve seat element 26 to valve seat carrier 21.

In the embodiment shown in FIG. 4, valve seat element 26 has a circumferential flange 64 positioned below the downstream end of valve seat carrier 21. Upper side 65 of circumferential flange 64 is ground in a clamp along with guide opening 55 and valve seat surface 27. The three-disc valve body is inserted until upper side 65 of flange 64 comes to rest against end 25 of valve seat carrier 21. In this contact area, both components 21 and 26 are welded together. Discharge opening 32 is provided, for example, at an angle in relation to longitudinal valve axis 8 and ends in a convex spray area 66 in the downstream direction.

Figure 4:
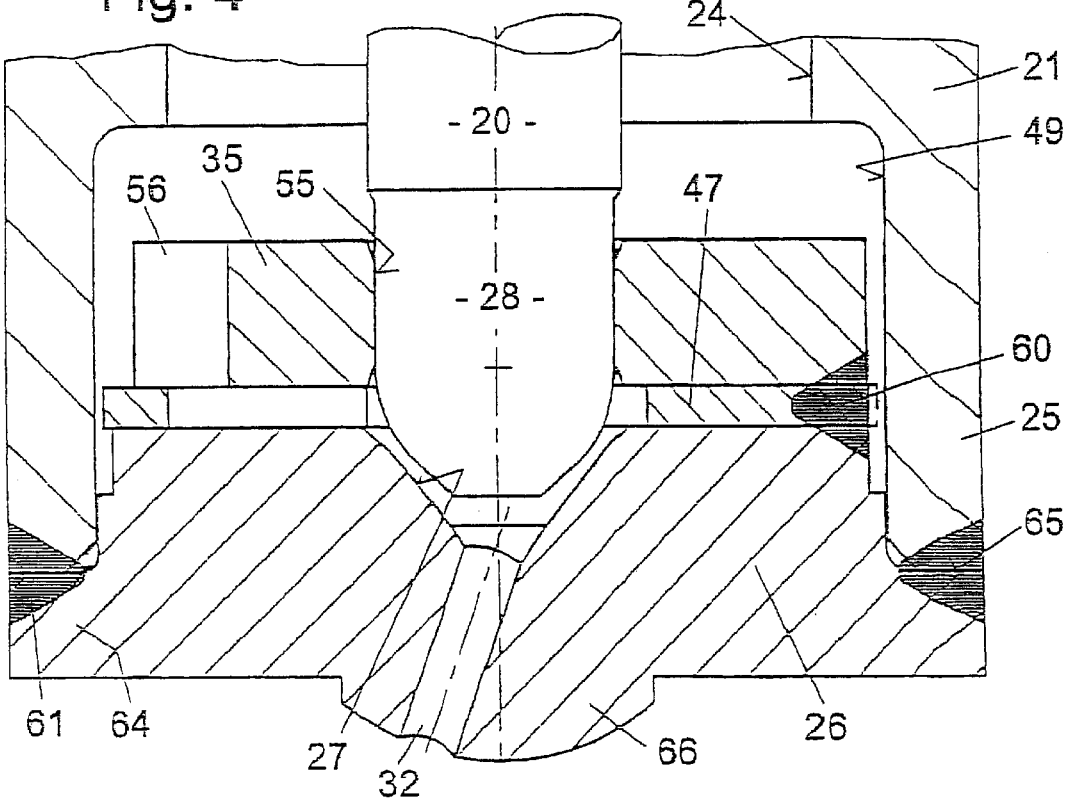
FIG. 4 shows an enlarged section of a second embodiment of a guide and seating area according to the present invention.
Figure 5:
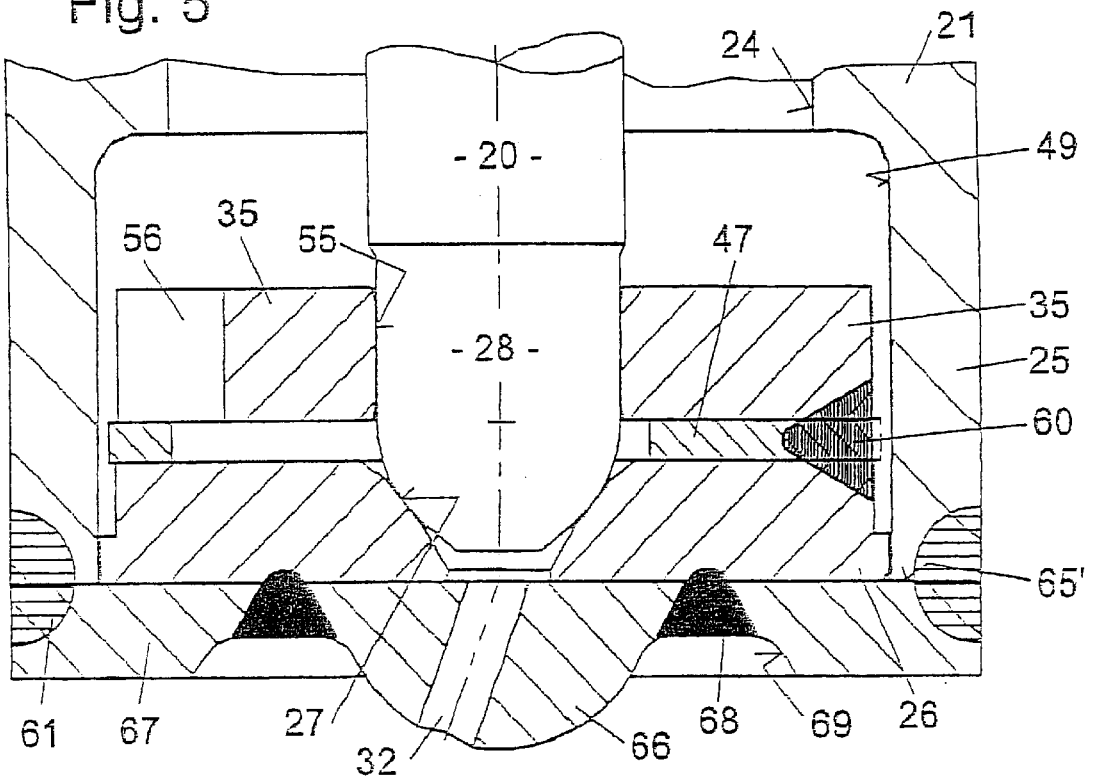
FIG. 5 shows an enlarged section of a third embodiment of a guide and seating area according to the present invention.

The embodiment shown in FIG. 5 largely corresponds to the embodiment illustrated in FIG. 4, the main difference is that an additional, fourth disc-shaped spray element 67 is provided in the form of a perforated spray disc that contains discharge opening 32. Compared to FIG. 4, therefore, valve seat element 26 is further divided downstream from valve seat surface 27. Spray element 67 and valve seat element 26 are permanently connected to one another, for example by a welded seam 68 produced by laser welding, with the welding being carried out in an annular depression 69. In addition to laser welding, bonding or resistance welding are among the other suitable joining methods for this connection. Both components are permanently connected to each other in the region of upper side 65' of injection element 67 and end 25 of valve seat carrier 21 (welded seam 61).

To protect against wear and tear, valve seat element 26 has a high carbon content and is well tempered. This makes it less easy to weld. Spray element 67, however, is made of a more weldable material. Furthermore, welded seam 68 needs to withstand only moderate stress. Discharge opening 32 can be provided late in the manufacturing process through economical means, such as by drilling. At the entrance to discharge opening 32 there is a sharp hole edge, which produces turbulence in the flow, thereby causing the flow to atomize into particularly fine droplets.

Figure 6:
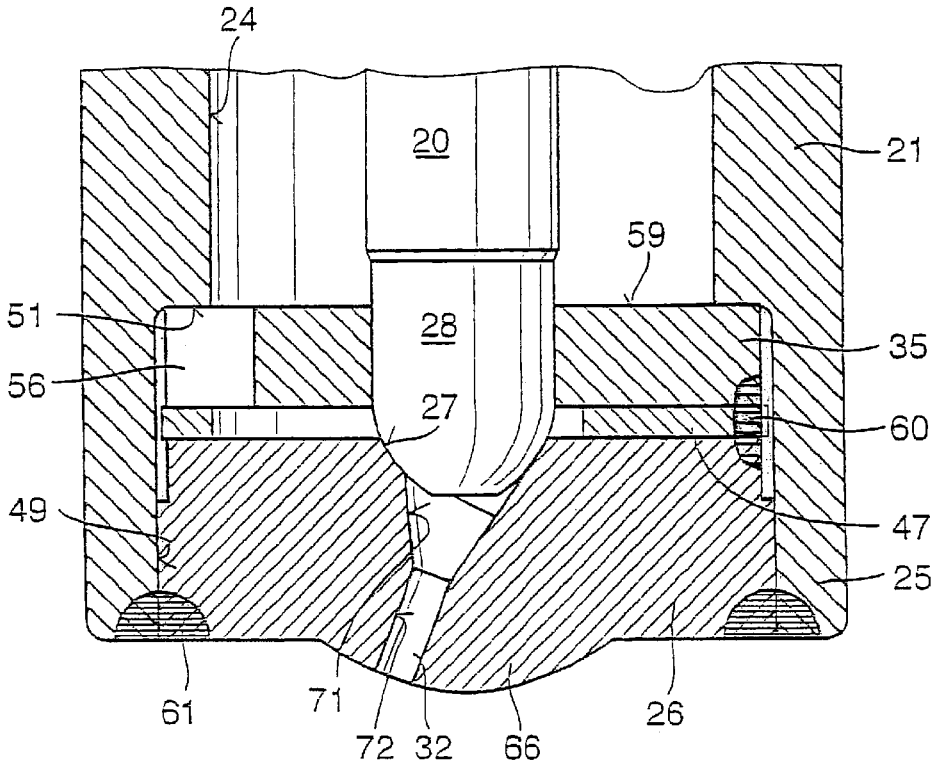
FIG. 6 shows an enlarged section of a fourth embodiment of a guide and seating area according to the present invention.

The embodiment shown in FIG. 6 is largely comparable to the one in FIG. 3. However, valve seat element 26 now has a discharge opening 32 that is inclined at an angle in relation to longitudinal valve axis 8. Discharge opening 32 is divided, for example, into a first inclined conical segment 71 and a subsequent second inclined cylindrical segment 72 in the downstream direction, with the angle of inclination of segment 72 in relation to longitudinal valve axis 8 being greater than the one of segment 71 in relation to longitudinal valve axis 8. Valve seat element 26 has a central convex spray area 66 in which discharge opening 32 ends. Designing discharge opening 32 in this manner diverts the fuel from the seating area to discharge opening 32 in a manner that produces particularly little turbulence. This minimizes flow dispersion. A completely conical discharge opening 32 is also conceivable as an alternative.

Figure 7:
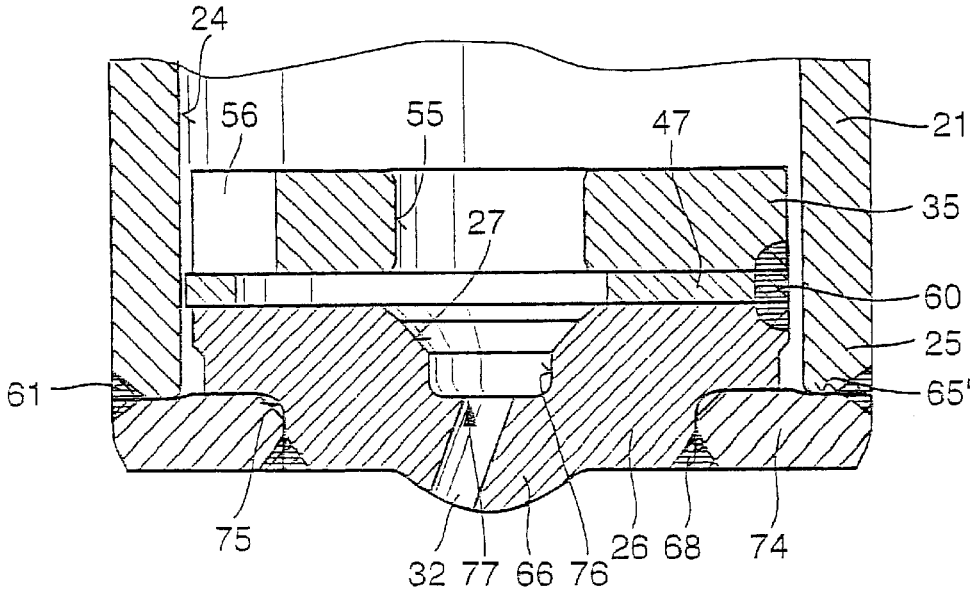
FIG. 7 shows an enlarged section of a fifth embodiment of a guide and seating area according to the present invention.

Like the embodiment shown in FIG. 5, the embodiment according to FIG. 7 has an additional, fourth disc-shaped fastening element 74. Valve seating element 26 has a shoulder 75 on its outer circumference that is surrounded by a ring-shaped fastening element 74. A welded seam 68 permanently connects fastening element 74, which is made of an easily weldable material, to valve seat element 26. Valve seat element 26 has, for example, a cylindrical segment 76 between valve seat surface 27 and discharge opening 32. This produces a well-defined inner spray hole edge 77 at the transition to discharge opening 32, thus sharply diverting the flow. The resulting turbulence provides a particularly fine atomization of the fuel.

Figure 8:
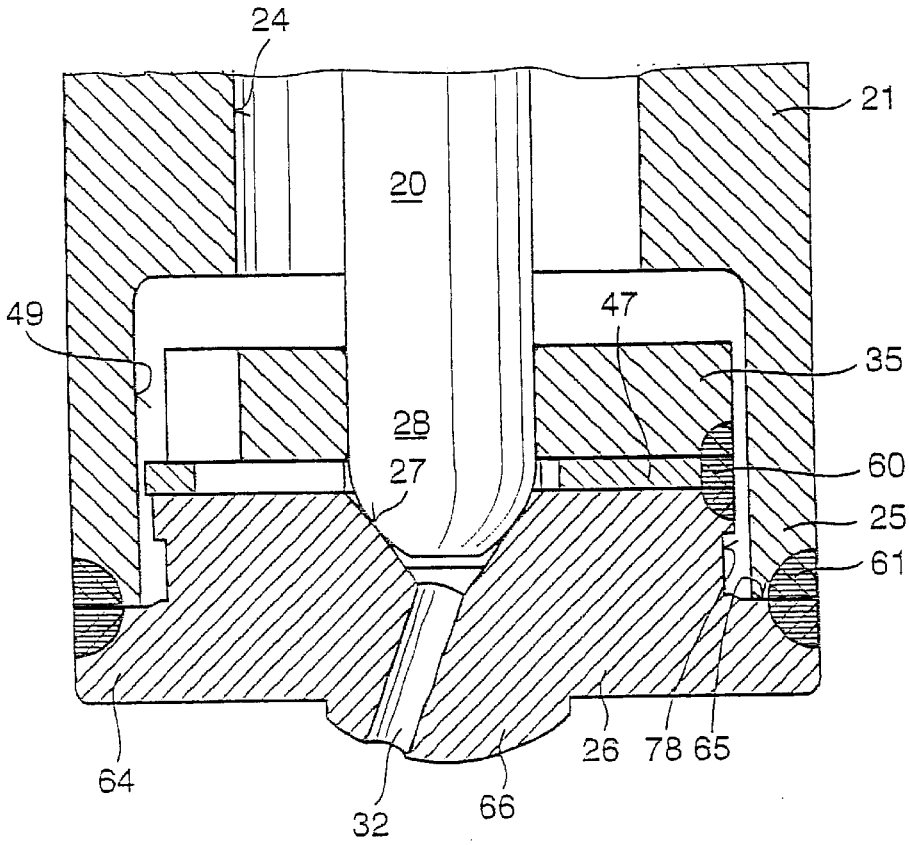
FIG. 8 shows an enlarged section of a sixth embodiment of a guide and seating area according to the present invention.

FIG. 8 shows an embodiment that is a slight modification of the embodiment illustrated in FIG. 4. The main difference lies in the provision of a circumferential groove 78 on the 20 outer circumference of valve seat element 26 above upper side 65 of flange 64. When upper side 65 of flange 64 is ground, a grinding tool (not illustrated), such as a grinding wheel, can advantageously dip farther into valve seat element 26 in a radial direction, providing a larger upper side 65. As a 25 result there is no need for beveling at adjacent end 25 of valve seat carrier 21. In addition, this reliably prevents valve seat element 26 from tilting in relation to the longitudinal axis of valve seat carrier 21 during welding (welded seam 61).

Figure 9:
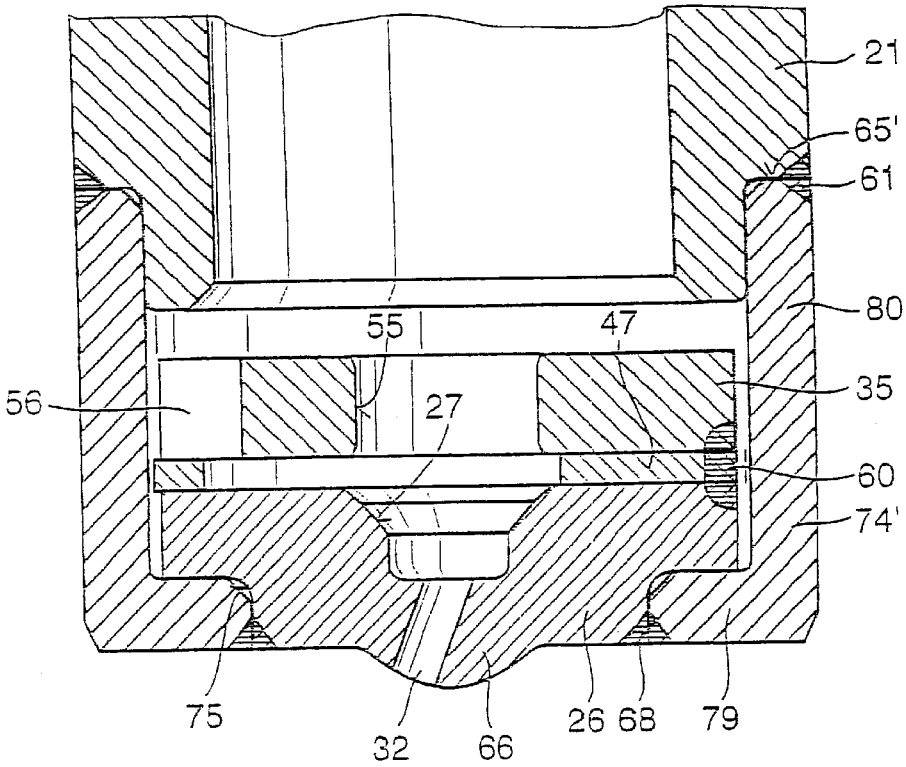
FIG. 9 shows an enlarged section of a seventh embodiment of a guide and seating area according to the present invention.

FIG. 9 shows an embodiment that is comparable to FIG. 7 in which ring-shaped fastening element 74 is replaced by a sleeve-shaped fastening element 74' that is permanently connected to valve seat element 26 by a base segment 79 and is permanently joined to valve seat carrier 21 by a jacket segment 80. Sleeve-shaped fastening element 741 is made of an easily weldable material. Highly stressed welded seam 61 is thus applied to two easily welded materials. Welded seam 68, however, does not have to withstand much stress because base segment 79 partially surrounds valve seat element 26.

Figure 10:
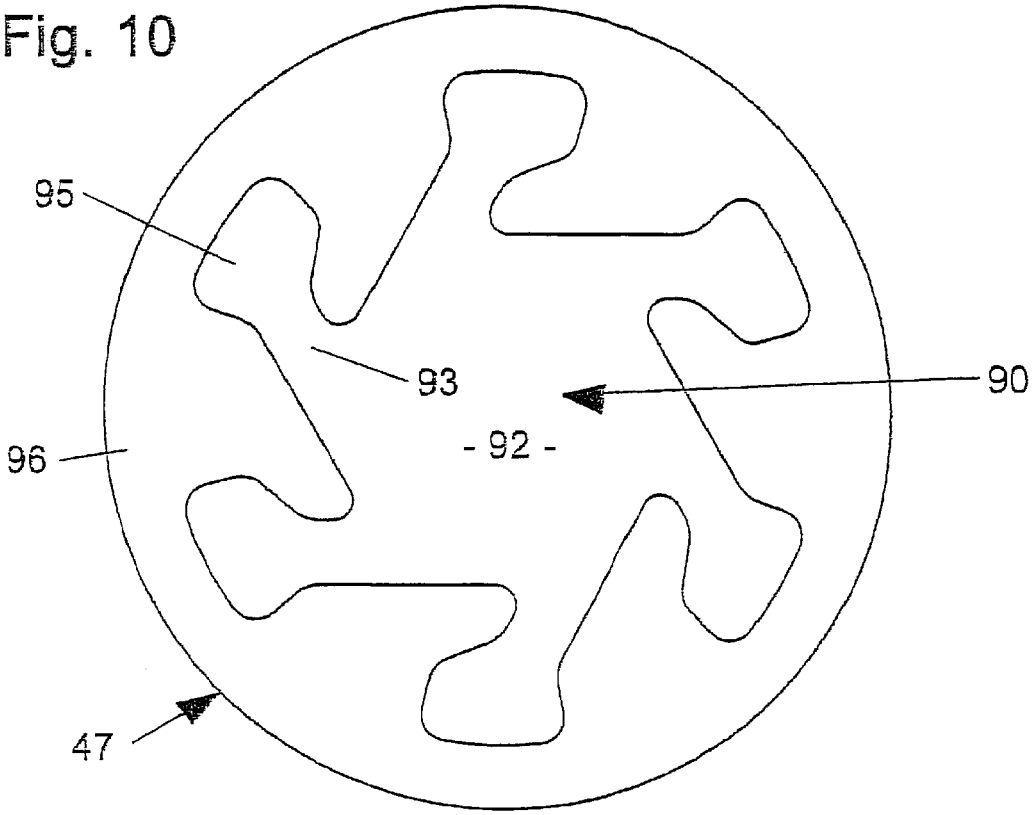
FIG. 10 shows a swirl element according to the present invention.

FIG. 10 shows a top view of a swirl element 47 embedded between guide element 35 and valve seat element 26 in the form of a single component. Swirl element 47 can be economically produced from sheet metal, for example by punching, wire EDM, laser cutting, etching, another conventional method or electroplating. An inner opening area 90, which runs across the entire axial thickness of swirl element 47, is provided in swirl element 47. Opening area 90 is formed by an inner swirl chamber 92, through which valve closing segment 28 of valve needle 20 extends, and by a plurality of swirl channels 93 opening into swirl chamber 92. Swirl channels 93 open tangentially into swirl chamber 92 and are not attached to the outer circumference of swirl element 47 by their ends 95 facing away from swirl chamber 92. Instead, a circumferential edge area 96 remains between ends 95 of swirl channels 93, which are designed as inlet pockets, and the outer circumference of swirl element 47.

After valve needle 20 is mounted, swirl chamber 92 is limited to the inside by valve needle 20 (valve closing segment 28) and to the outside by the wall of opening area 90 of swirl element 47. Because swirl channels 93 open tangentially into swirl chamber 92, an angular momentum is imparted on the fuel and remains while the fuel continues to flow into discharge opening 32. Due to centrifugal force, the fuel is sprayed in the shape of a hollow cone. Ends 95 of swirl channels 93 act as collecting pockets, which form a large reservoir, allowing the fuel to flow in with little turbulence. After the flow has been diverted, the fuel enters actual tangential swirl channels 63 slowly and without much turbulence, making it possible to produce a largely trouble-free swirling motion.

Figure 11:
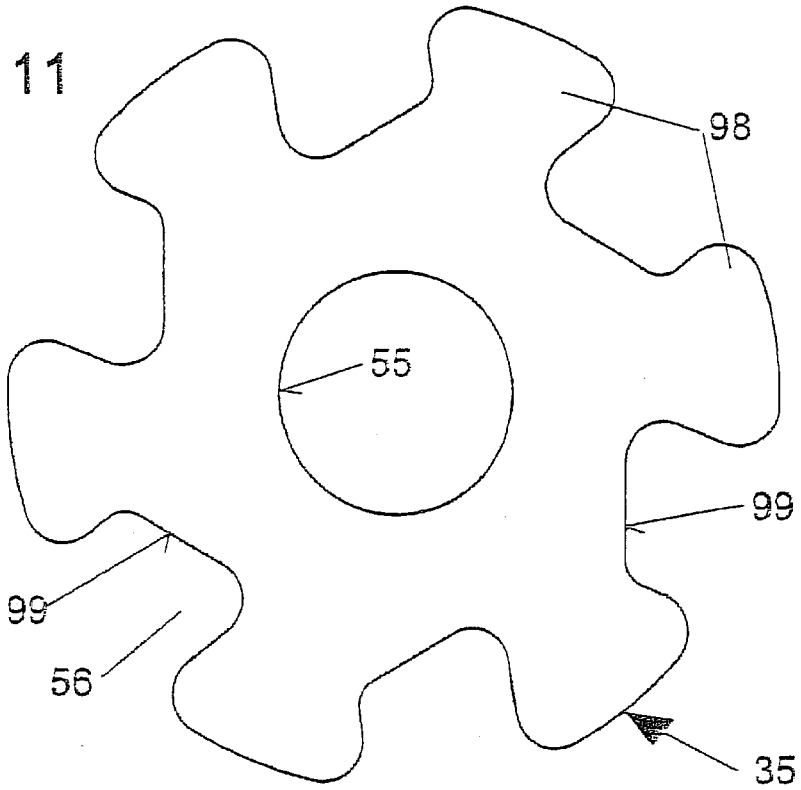
FIG. 11 shows a first embodiment of a guide element according to the present invention.
Figure 12:
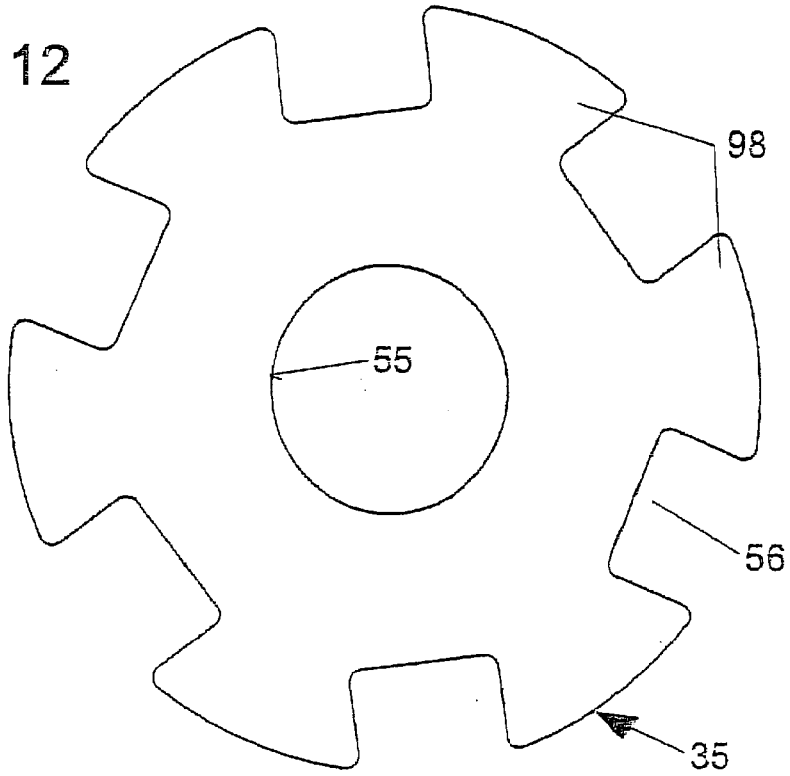
FIG. 12 shows a second embodiment of a guide element according to the present invention.

FIGS. 11 and 12 show two embodiments of guide elements 35, although they can also be used in many other embodiments. Guide elements 35 have recesses 56 that alternate with projecting tooth-shaped areas 98 around their outer circumference. Tooth-shaped areas 98 can have sharp edges (FIG. 12) or a rounded design (FIG. 11). If areas 98 and recesses 56 are designed symmetrically, guide elements 35 can be mounted on either side. Possible methods for producing guide elements 35 include punching. In the embodiment shown in FIG. 11, recess bases 99 have a sloping design, causing recess bases 99 to advantageously run perpendicular to the axes of swirl channels 93 in underlying swirl element 47.

Figure 13:
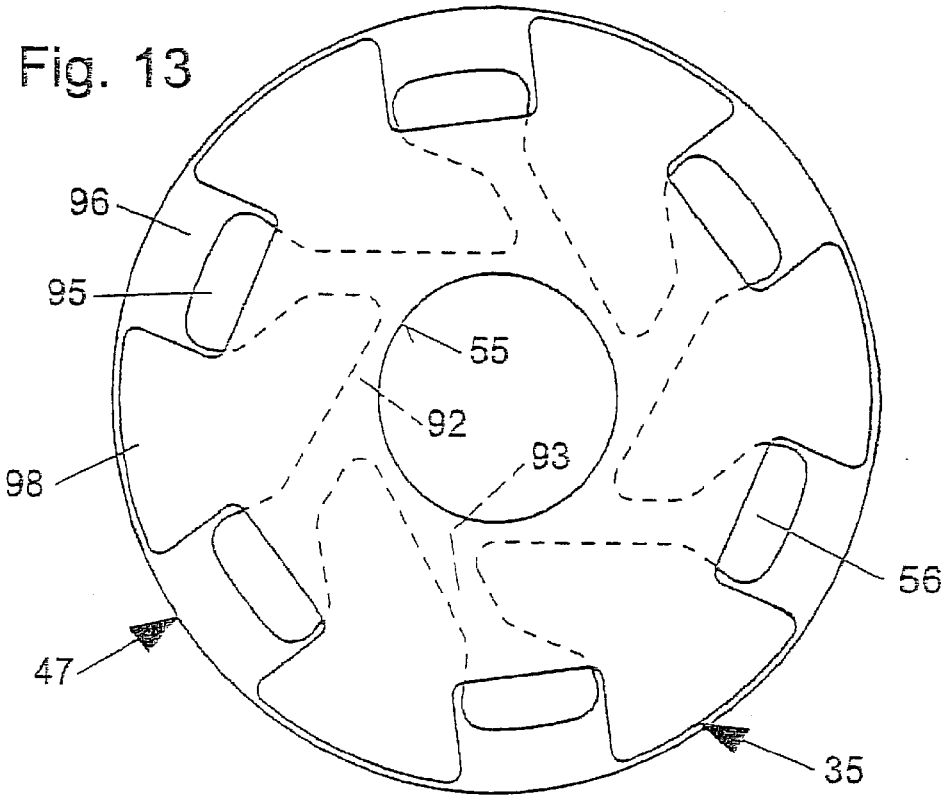
FIG. 13 shows the swirl element shown in FIG. 10 and the guide element shown in FIG. 12 vertically assembled.

FIG. 13 shows a top view of assembled swirl element 47 according to FIG. 10 and guide element 35 according to FIG. 12 mounted on top of it, clearly showing that ends 95 of swirl channels 93 are positioned directly beneath recesses 56 between areas 98 in the form of inlet pockets for the fuel. Thus ends 95 of swirl channels 93 in swirl element 47 and recesses 56 of guide element 35 are thus oriented precisely toward one another in their rotary position.

Figure 14:
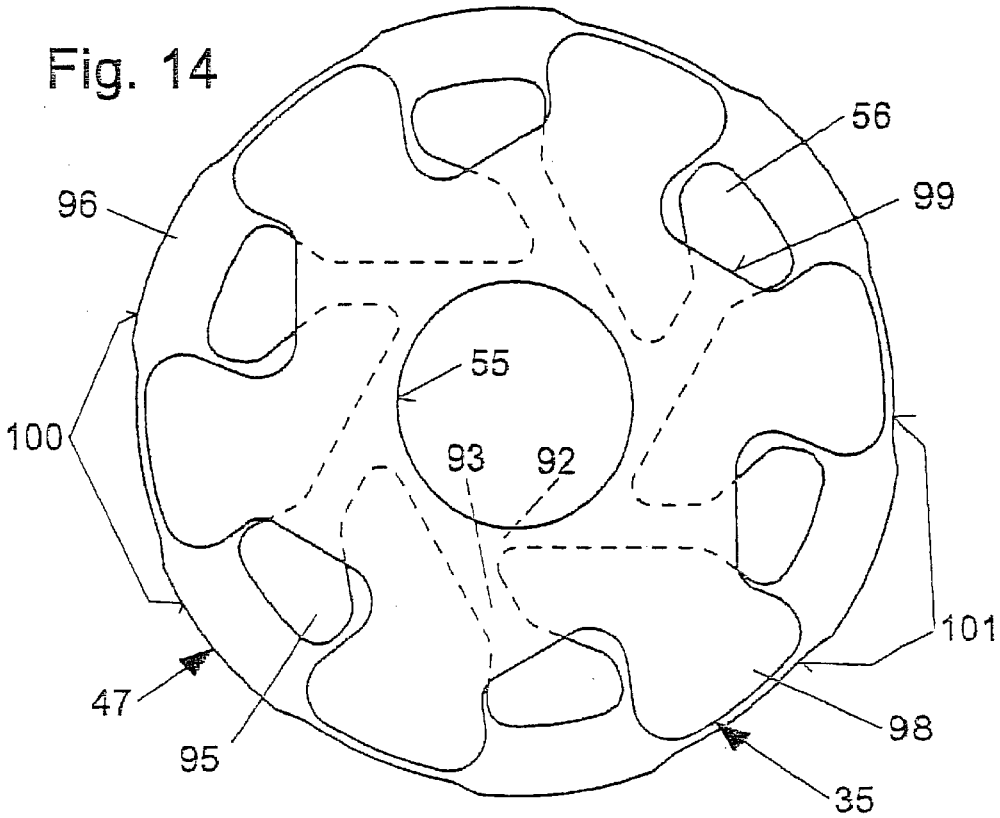
FIG. 14 shows a swirl element with centering areas and the guide element shown in FIG. 11 vertically assembled.

FIG. 14 shows a swirl element 47 has multiple centering areas 100 distributed across its circumference and guide element 35 according to FIG. 11, with both elements assembled vertically. Swirl element 47, for example, has a number of centering areas 100 equal to the number of swirl channels 93 in the circumferential area of ends 95, with these centering areas 100 having a slightly larger outer diameter than remaining areas 101 of swirl element 47. Viewed across the circumference, centering areas 100, which represent elevations, therefore alternate with recessed remaining areas 101. Welding 60 is carried out in recessed remaining areas 101 of swirl element 47. Centering areas 100 are used to center the entire valve body in lower segment 49 of passage 24 in valve seat carrier 21.

Figure 15:
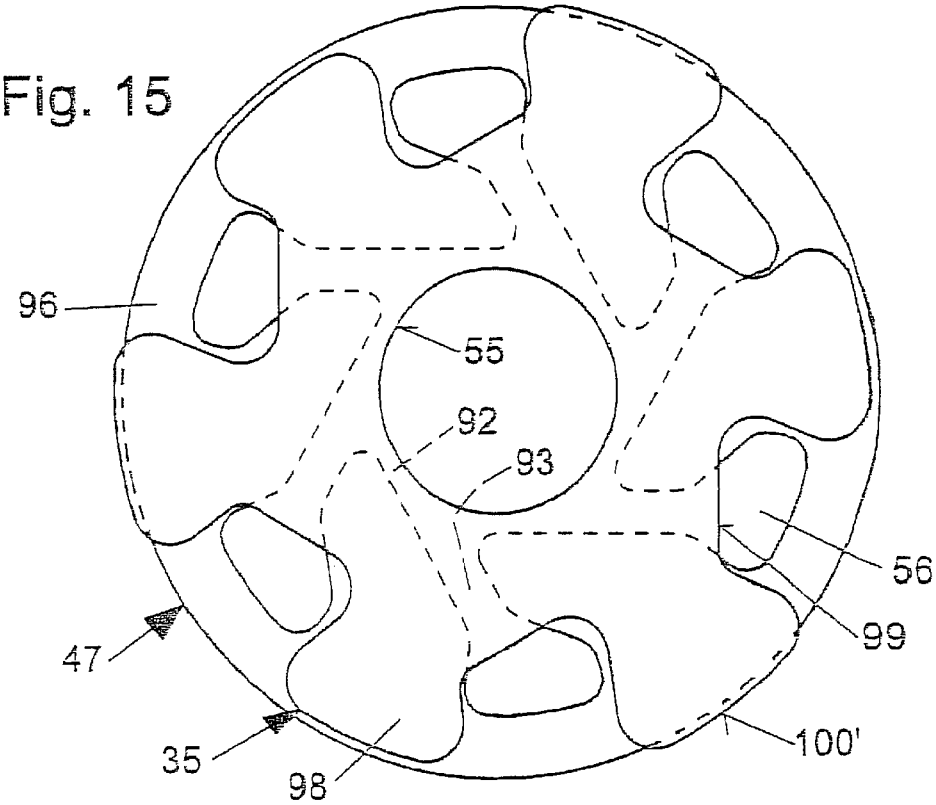
FIG. 15 shows the swirl element shown in FIG. 10 and a guide element with centering areas vertically assembled.

Like centering areas 100 on swirl element 47, areas 98 of guide element 35 can also be designed as centering areas 100' that project slightly in the radial direction. FIG. 15 shows a swirl element 47 according to FIG. 10 and a guide element 35 similar to the one in FIG. 11, with both elements assembled vertically and guide element 35 designed with multiple centering areas 100' distributed across its circumference. For example, every second area 98 on guide element 35 has a slightly greater length in the radial direction than intermediate areas 98, with centering areas 100' projecting slightly over the outer diameter of swirl element 47, enabling the arrangement to be centered in valve seat carrier 21.

FIGS. 16 and 17 and FIGS. 18 and 19, respectively, show three further embodiments that differ from the embodiments illustrated in FIGS. 1 through 15 in that guide element 35 is designed with a smaller outer diameter than subsequent downstream swirl element 47, thus providing other ways of connecting guide element 35, swirl element 47, and valve seat element 26, forming a positive-locking joint. As illustrated by the top view of the guide and seating area shown in FIG. 16, guide element 35 is designed with an outer diameter that enables ends 95 of swirl channels 93 forming inlet pockets to be at least partially exposed. This makes it possible to dispense with the toothed-gear design of guide element 35 with recesses 56 (see FIGS. 11 and 12) because the fuel can now flow from the outer circumference directly into ends 95 of swirl channels 93. Due to its simple geometry, guide element 35 can be formed very inexpensively, e.g. by punching. Another advantage is that it is no longer necessary to precisely align the rotary position of guide element 35 with swirl element 47, as was required in the embodiments described above. Guide element 35 is now only a cover for swirl element 47 and can be mounted in a position that is independent of its relation to swirl channels 93.

Figure 17:
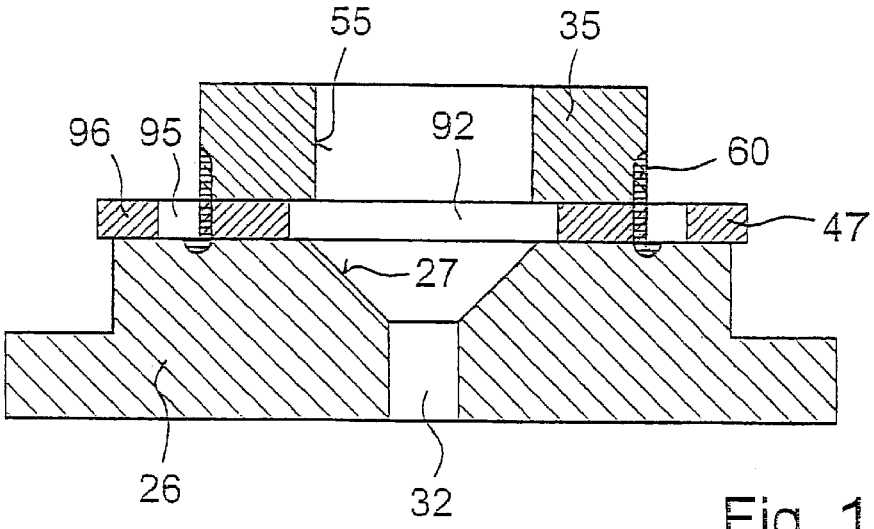
FIG. 17 shows a section along the line XVII-XVII shown in FIG. 16.
Figure 16:
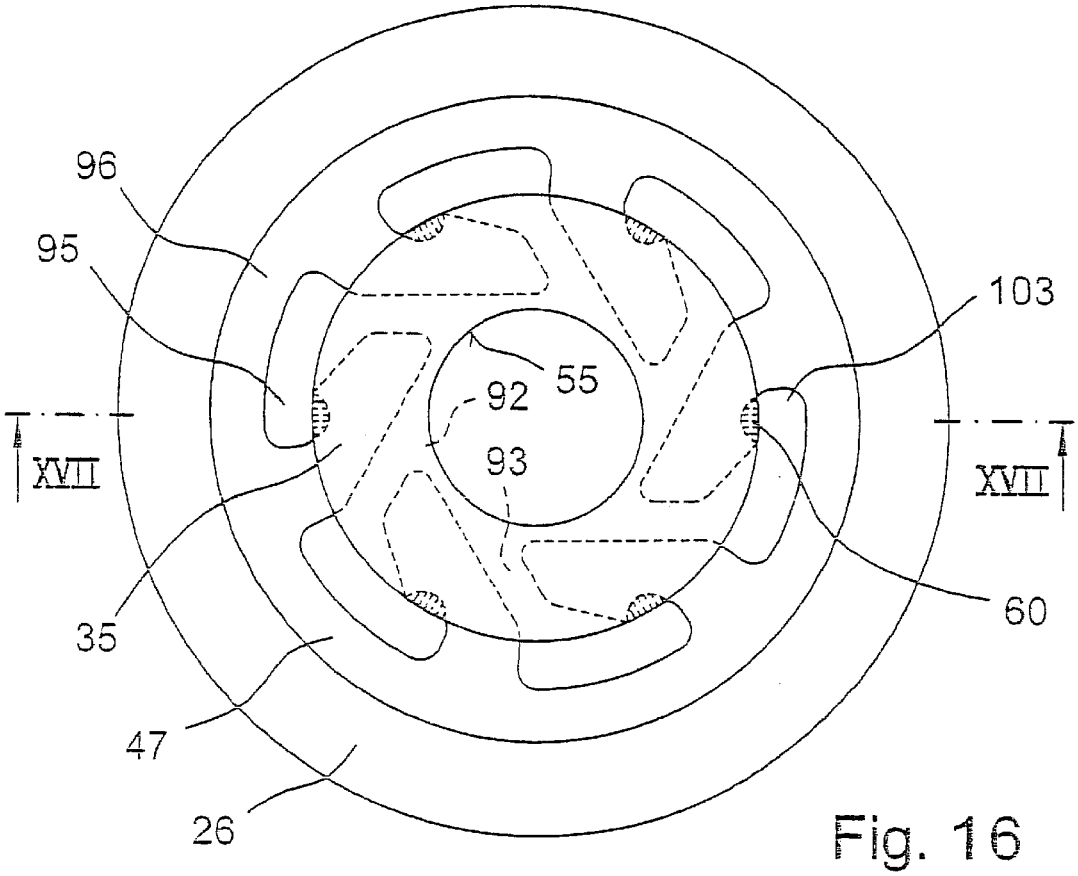
FIG. 16 shows a top view of an eighth embodiment of a guide and seating area according to the present invention.

Ends 95 of swirl channels 93 are ideally designed with elongations 103 extending in the circumferential direction and of a sufficient size to allow a spot weld, i.e. a short welded seam 60, to be set in the region of each end 95. In doing this, the spot weld, i.e. welded seam 60, is placed in the exact location where the outer edge of guide element 35 is positioned over the limiting wall of elongation 103 of end 95 of corresponding swirl channel 93, thus making it possible to produce an especially simple and economical, permanent positive-locking connection between guide element 35, swirl element 47, and valve seat element 26. The number of swirl channels 93 thus equals the number of spot welds 60. As illustrated in FIG. 17, spot welds, i.e. welded seams 60, include all three elements 35, 47, and 26 in the form of penetration welded joints, providing very reliable connections.

Figure 18:
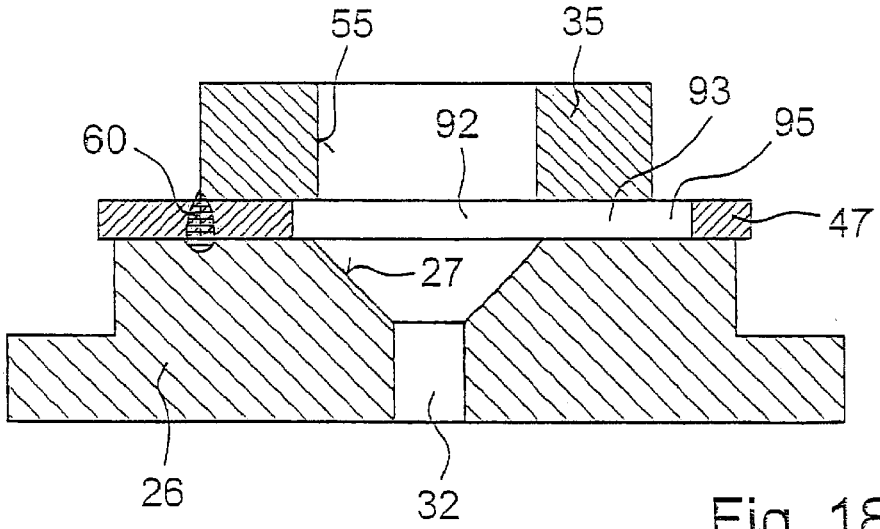
FIG. 18 shows an enlarged view of a ninth embodiment of a guide and seating area according to the present invention.
Figure 19:
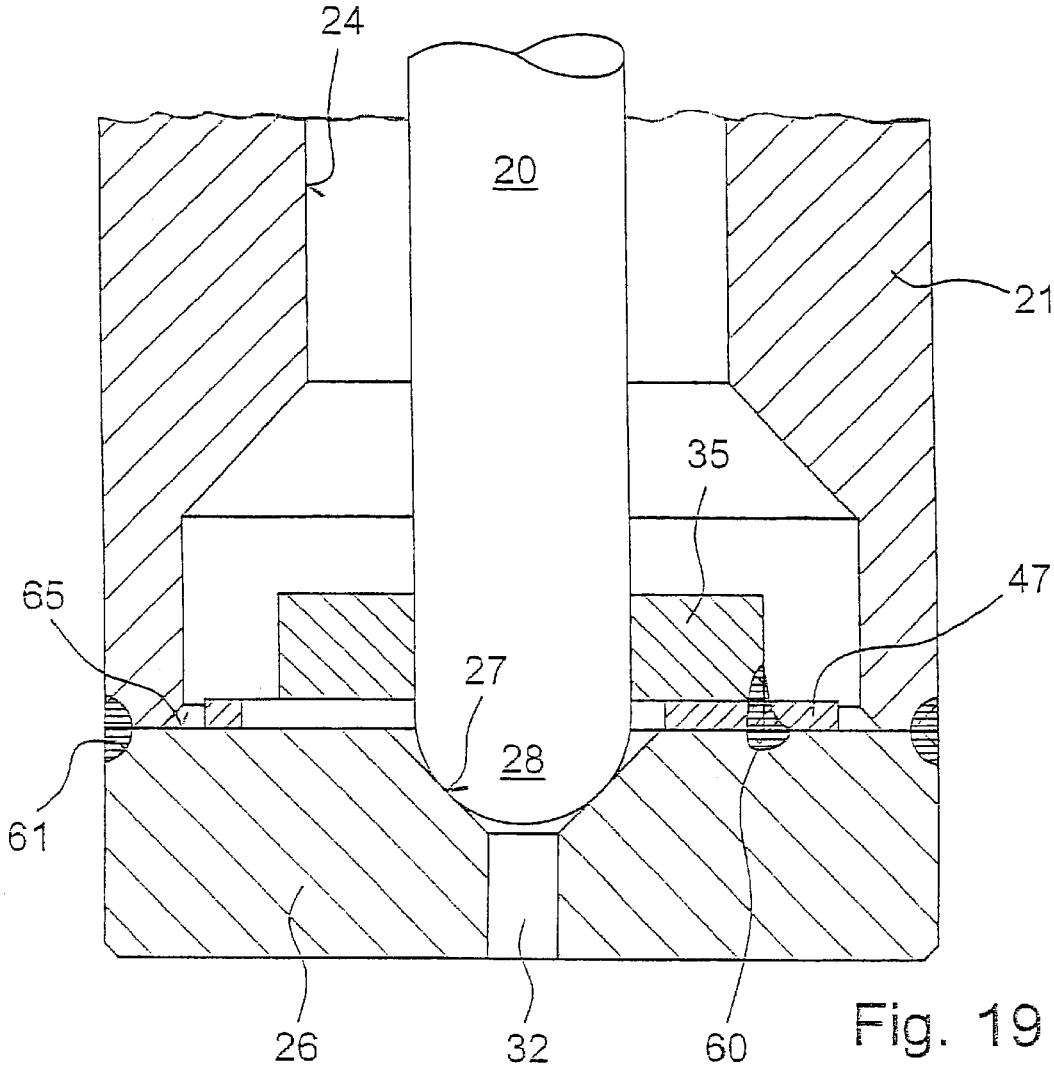
FIG. 19 shows an enlarged section of a ninth embodiment of a guide and seating area according to the present invention.

In the embodiments illustrated in FIGS. 18 and 19, penetration welded joints are produced which are independent of ends 95 of swirl channels 93. Instead, the spot welds, i.e. welded seams 60, penetrate the material in the circumferential regions between ends 95, requiring a greater amount of welding power. However, the spot welds, i.e. welded seams 60, are located precisely at the outer edge of guide element 35. FIGS. 18 and 19 illustrate welded seams 60 of this type in the form of fillet welds that permanently connect three elements 35, 47, and 26 in the form of penetration welded joints. Once again, the number of welded seams 60, for example, equals the number of swirl channels 93. The embodiment illustrated in FIG. 19 also shows a very simple valve seat element 26 that is produced in the form of a cylindrical component without any shoulders on its outer contour, making it highly resistant to bending. Shoulder-free upper side 65 of valve seat element 26 rests against valve seat carrier 21 in its radial outer region, making it possible to very easily provide welded seam 61 to achieve a permanent connection between both components.

What is claimed is:

1. A fuel-injection valve for a fuel-injection system of an internal combustion engine, comprising:

a valve seat element having a stationary valve seat arranged on the valve seat element;

an excitable actuating element having a valve closing member, the valve closing member being movable along a longitudinal valve axis in an axial direction and interacting with the stationary valve seat to open and close the valve;

a disc-shaped swirl element arranged directly upstream from the stationary valve seat; and a guide element arranged upstream from the disc-shaped swirl element, the guide element having an inner guide opening for guiding the valve closing member passing through the inner guide opening, wherein:

the guide element, the disc-shaped swirl element, and the valve seat element are permanently connected to each other to form a positive-locking joint.

2. The valve according to claim 1, wherein:

the valve is for directly injecting a fuel into a combustion chamber of the internal combustion engine.

3. The valve according to claim 1, wherein:

the disc-shaped swirl element has an inner opening area, the inner opening area extends completely over an entire axial thickness of the disc-shaped swirl element and includes a plurality of swirl channels, and the plurality of swirl channels are separated from an outer circumference of the disc-shaped swirl element by a circumferential edge area.

4. The valve according to claim 3, wherein:

the inner opening area is formed by a punching operation.

5. The valve according to claim 3, wherein:

the inner opening area is formed by an inner swirl chamber and the plurality of swirl channels opening into the inner swirl chamber.

6. The valve according to claim 5, wherein:

the plurality of swirl channels have ends arranged at a distance from the inner swirl chamber, and the ends form inlet pockets that have a larger cross-section than a remaining portion of the plurality of swirl channels.

7. The valve according to claim 6, wherein:

the guide element has projecting tooth-shaped areas alternating with intermediate recesses across an outer circumference of the guide element, and the disc-shaped swirl element is arranged downstream from the guide element so that the ends of the plurality of swirl channels are arranged directly beneath the intermediate recesses of the guide element and allow a fuel to flow through the intermediate recesses and the ends.

8. The valve according to claim 6, wherein:

the guide element has an outer circumference smaller than the outer circumference of the disc-shaped swirl element, and the ends of the plurality of swirl channels each has a limiting wall arranged directly beneath the outer circumference of the guide element in a downstream direction, a permanent positive-locking connection being provided in an area of the outer circumference of the guide element.

9. The valve according to claim 1, wherein:

the guide element has projecting tooth-shaped areas alternating with intermediate recesses across an outer circumference of the guide element.

10. The valve according to claim 9, wherein:

the intermediate recesses have recess bases, and the recess bases extend according to a configuration that is one of perpendicular to edges of the tooth-shaped areas and at angle to the edges of the tooth-shaped areas.

11. The valve according to claim 1, wherein:

the guide element has an outer circumference smaller than the outer circumference of the disc-shaped swirl element, and the positive-locking joint is provided in an area of the outer circumference of the guide element.

12. The valve according to claim 1, further comprising:

a valve seat carrier having a passage, the guide element, the disc-shaped swirl element, and the valve seat element being arranged together in the passage and at least partially surrounded by the valve seat carrier.

13. The valve according to claim 12, wherein:

the passage has a stage, a lower segment extending in a downstream direction from the stage and holding the valve seat element, the disc-shaped swirl element, and the guide element, the lower segment having a diameter larger than a diameter of the stage.

14. The valve according to claim 13, wherein:

the guide element has an upper end, the upper end partially resting against the stage of the valve seat carrier.

15. The valve according to claim 12, wherein:

the valve seat element is permanently connected to the valve seat carrier by a circumferential welded seam.

16. The valve according to claim 15, wherein:

the valve seat element has a flange, the permanent connection with the valve seat carrier being provided at the flange.

17. The valve according to claim 12, further comprising:

a spray element permanently connected to the valve seat element and the valve seat carrier, the spray element being arranged downstream from the valve seat element, and the spray element including at least one discharge opening.

18. The valve according to claim 12, further comprising:

a fastening element permanently connected to the valve seat element and the valve seat carrier.

19. The valve according to claim 12, wherein:

at least one of the disc-shaped swirl element and the guide element have centering areas arranged on an outer circumference of the at least one of the disc-shaped swirl element and the guide element, the centering areas being used to center the valve seat element, the disc-shaped swirl element, and the guide element in the passage.

20. The valve according to claim 1, wherein:

the permanent connection between the guide element, the disc-shaped swirl element, and the valve seat element is produced by one of welding, soldering, bonding, and gluing.

21. A fuel-injection valve for a fuel-injection system of an internal combustion engine, comprising:

a valve seat element having a stationary valve seat arranged on the valve seat element;

an excitable actuating element having a valve closing member, the valve closing member being movable along a longitudinal valve axis in an axial direction and interacting with the stationary valve seat to open and close the valve;

a disc-shaped swirl element arranged directly upstream from the stationary valve seat; and a guide element arranged upstream from the disc-shaped swirl element, the guide element having an inner guide opening for guiding the valve closing member passing through the inner guide opening, wherein:

the guide element, the disc-shaped swirl element, and the valve seat element are permanently connected to each other to form an integral unit.

* * * * *